US012514359B2

(12) United States Patent
Dennis

(10) Patent No.: US 12,514,359 B2
(45) Date of Patent: Jan. 6, 2026

(54) BACKPACK LAPTOP RISER

(71) Applicant: Carl Dennis, Brooklyn, NY (US)

(72) Inventor: Carl Dennis, Brooklyn, NY (US)

( * ) Notice: Subject to any disclaimer, the term of this patent is extended or adjusted under 35 U.S.C. 154(b) by 99 days.

(21) Appl. No.: 18/640,469

(22) Filed: Apr. 19, 2024

(65) Prior Publication Data

US 2024/0358144 A1 Oct. 31, 2024

Related U.S. Application Data

(60) Provisional application No. 63/462,495, filed on Apr. 27, 2023.

(51) Int. Cl.

| | |
|---|---|
| ***A45F 4/02*** | (2006.01) |
| ***A45C 13/06*** | (2006.01) |
| ***A45C 13/10*** | (2006.01) |
| ***A45C 13/30*** | (2006.01) |
| ***A45F 3/04*** | (2006.01) |
| *A45F 5/00* | (2006.01) |

(52) U.S. Cl.

CPC ..... *A45F 4/02* (2013.01); *A45C 13/06* (2013.01); *A45C 13/103* (2013.01); *A45C 13/30* (2013.01); *A45F 3/04* (2013.01); *A45C 2200/15* (2013.01); *A45F 5/1525* (2025.01)

(58) Field of Classification Search

CPC ..... A45C 11/003; A45C 13/06; A45C 13/10; A45C 13/30; A45C 2013/025; A45C 2200/15; A45C 7/0095; A45C 9/00; A45F 3/04; A45F 4/02; A45F 5/1525

USPC ..... 224/153

See application file for complete search history.

(56) References Cited

U.S. PATENT DOCUMENTS

| | | | | |
|---|---|---|---|---|
| 3,021,000 A * | 2/1962 | Meyers | A45C 9/00 206/45.21 |
| 6,474,524 B1 * | 11/2002 | Ivarson | A45F 3/04 224/653 |
| 8,424,730 B2 * | 4/2013 | Brunning | A45F 4/02 224/155 |

(Continued)

FOREIGN PATENT DOCUMENTS

| | | | |
|---|---|---|---|
| JP | 6625590 B2 * | 12/2019 | A45F 4/00 |
| KR | 20120002281 U * | 3/2012 | A45F 3/08 |

OTHER PUBLICATIONS

KR-20120002281-U Translation, 이원재, Mar. 28, 2012 (Year: 2012).*

(Continued)

*Primary Examiner* — Nathan J Newhouse
*Assistant Examiner* — Matthew T Theis
(74) *Attorney, Agent, or Firm* — Morse, Barnes-Brown & Pendleton, P.C.; Sean D. Detweiler, Esq.

(57) ABSTRACT

A versatile backpack is disclosed, capable of transforming into a laptop stand. The backpack features a rigid structure comprising a bottom panel, two side panels, a front panel, and a back panel with a pivotable top section. A soft top panel encloses the interior volume of the backpack with a closeable opening. Shoulder straps allow for comfortable wear. The top back panel can fold down to meet the side panels, creating a rigid box structure suitable for supporting a laptop. This innovative design provides a convenient and portable solution for users needing both a backpack and a laptop stand in one compact unit.

18 Claims, 11 Drawing Sheets

(56) References Cited

U.S. PATENT DOCUMENTS

| | | | | |
|---|---|---|---|---|
| 11,708,193 | B2 * | 7/2023 | Babuka | A45F 4/02 220/629 |
| 2008/0061093 | A1 * | 3/2008 | Pottharst | A45C 11/20 224/155 |
| 2016/0045009 | A1 * | 2/2016 | Hansborough | A45C 13/28 190/11 |
| 2016/0128454 | A1 * | 5/2016 | Han | A45F 5/00 224/153 |
| 2023/0331474 | A1 * | 10/2023 | Leinster | B65F 1/1646 |
| 2024/0245203 | A1 * | 7/2024 | John | A45F 4/02 |

OTHER PUBLICATIONS

JP-6625590-B2 Translation, パク ウォンギュ, Dec. 25, 2019 (Year: 2019).*

* cited by examiner

BACKPACK LAPTOP RISER

CROSS-REFERENCE TO RELATED APPLICATION(S)

This application claims priority to, and the benefit of, U.S. Provisional Application No. 63/462,495, filed Apr. 27, 2023, for all subject matter common to both applications. The disclosure of said provisional application is hereby incorporated by reference in its entirety.

FIELD OF THE INVENTION

The present invention relates to backpacks suitable for holding and transporting laptop computers. In particular, the present invention relates to a backpack configured to additionally function as a riser or stand for the laptop computer.

BACKGROUND

Generally, many backpacks include compartments for holding and transporting laptop computers. These can include sleeves or padded sections within the backpack. These backpacks have made traveling with laptop computers and remote work more convenient.

However, while these backpacks can hold and transport laptop computers, they typically do not provide a surface configured to support a laptop computer. That is, when traveling, a user may not have access to a suitable work surface onto which to deploy the laptop computer. Thus, the laptop computer may be deployed on a user's lap. This can be uncomfortable for the user as the laptop may generate heat and cause the laptop computer to be in an awkward position for use. To alleviate this issue the user may place an object such as a pillow or a conventional backpack between the laptop computer and their lap. The problem with such objects is they do not provide an ideal flat rigid surface for deploying the laptop at a comfortable height, and with an irregular, non-flat, fabric surface (such as that of a conventional backpack) the cooling ducts of the laptop can be unintentionally blocked or hindered. Furthermore, in the case of the backpack, the straps of the backpack can present a snagging issue wherein the straps could be caught on arms, legs, pets, or objects and cause the backpack (and laptop) to be pulled out of position possibly damaging the laptop if it topples.

SUMMARY

There is a need for a backpack that can function as a riser or stand for the laptop as well as store and transport the laptop. The present invention is directed toward further solutions to address this need, in addition to having other desirable characteristics.

In accordance with example embodiments of the present invention, a backpack is provided that converts into a laptop stand, the backpack including: a rigid bottom panel; a first rigid side panel attached to the rigid bottom panel; a second rigid side panel attached to the rigid bottom panel opposite the first rigid side panel; a rigid front panel attached to the rigid bottom panel, the first rigid side panel, and the second rigid side panel; a rigid back panel including: a rigid bottom back panel attached to the rigid bottom panel, the first rigid side panel, and the second rigid side panel opposite the rigid front panel; and a top rigid back panel pivotably attached to the rigid bottom back panel and configured to fold down in one direction; a soft top panel attached to the rigid front panel, the first and second rigid side panel and the rigid back panel opposite the rigid bottom panel enclosing the interior volume of the backpack and having a closeable opening into the interior volume; wherein the attached rigid bottom, side, front, and back panels define an interior volume of the backpack, a pair of shoulder straps attached to and extending between the top rigid back panel and the first and second rigid side panels in proximity to the rigid bottom panel and configured to allow the backpack to be worn by a user; and wherein the top rigid back panel can fold down over the soft top panel and the interior volume of the backpack to meet with the side panels forming a rigid box for supporting a laptop.

In accordance with aspects of the present invention, the closeable opening of the soft top panel includes a zippered opening.

In accordance with aspects of the present invention, the backpack further includes securing means disposed on each strap of the pair of shoulder straps; securing mean disposed on each of the first and second rigid side panels in proximity to the rigid bottom panel; wherein when the top rigid back panel is folded over the soft top panel and the interior volume of the backpack, each strap can be positioned across a side panel and secured to their respective side panel using the securing means to hold the top rigid back panel in position over the soft top panel and the interior volume of the backpack to form the rigid box. In some such aspects, the securing means includes clips, but can alternatively include other fasteners, such as hook and loop fasteners, hooks, latches, etc. In still further aspects, the rigid box can be used in a vertical or horizontal position for supporting a laptop.

In accordance with aspects of the present invention, the rigid front panel has a width dimension that is less than a width dimension of the rigid back panel and the rigid bottom panel has a substantially trapezoidal shape. In some such aspects, the top rigid back panel is configured to match the trapezoidal shape of the rigid bottom panel such that the rigid box formed by folding the top rigid back panel over the soft top panel and the interior volume of the backpack to meet with the rigid front and side panels has a substantially trapezoidal cross-sectional shape.

In accordance with aspects of the present invention, one or more of the rigid bottom, side, front, and back panels include an outer shell including a flexible material, and a frame including a rigid material providing structure and support for the outer shell. In some such aspects, the flexible material of the outer shell includes a fabric. In certain aspects, the frame includes a sheet of rigid material. In further aspects, the rigid material of the frame can be made of plastic, composite, wood, metal, or equivalents.

In accordance with example embodiments of the present invention, a method of converting a backpack into a laptop stand is provided. The method involves providing a backpack that can convert to a laptop stand as described herein and folding the top rigid back panel down of the backpack over the soft top panel and the interior volume of the backpack to meet with the side panels to form the rigid box.

In accordance with aspects of the present invention, the method further involves removing contents from the interior volume of the backpack that would interfere with conversion of the backpack into the laptop stand.

In accordance with aspects of the present invention, when the backpack further includes securing means disposed on each strap of the pair of shoulder straps and securing mean disposed on each of the first and second rigid side panels in proximity to the rigid bottom panel, the method further involves positioning each straps along the side panel and securing each strap to the respective side panel using the securing means to hold the top rigid back panel in position over the soft top panel and the interior volume of the backpack to form the rigid box. In some such aspects, the rigid box can then be oriented horizontally.

In accordance with aspects of the present invention, the method further involves placing a laptop upon a rigid panel of the rigid box.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
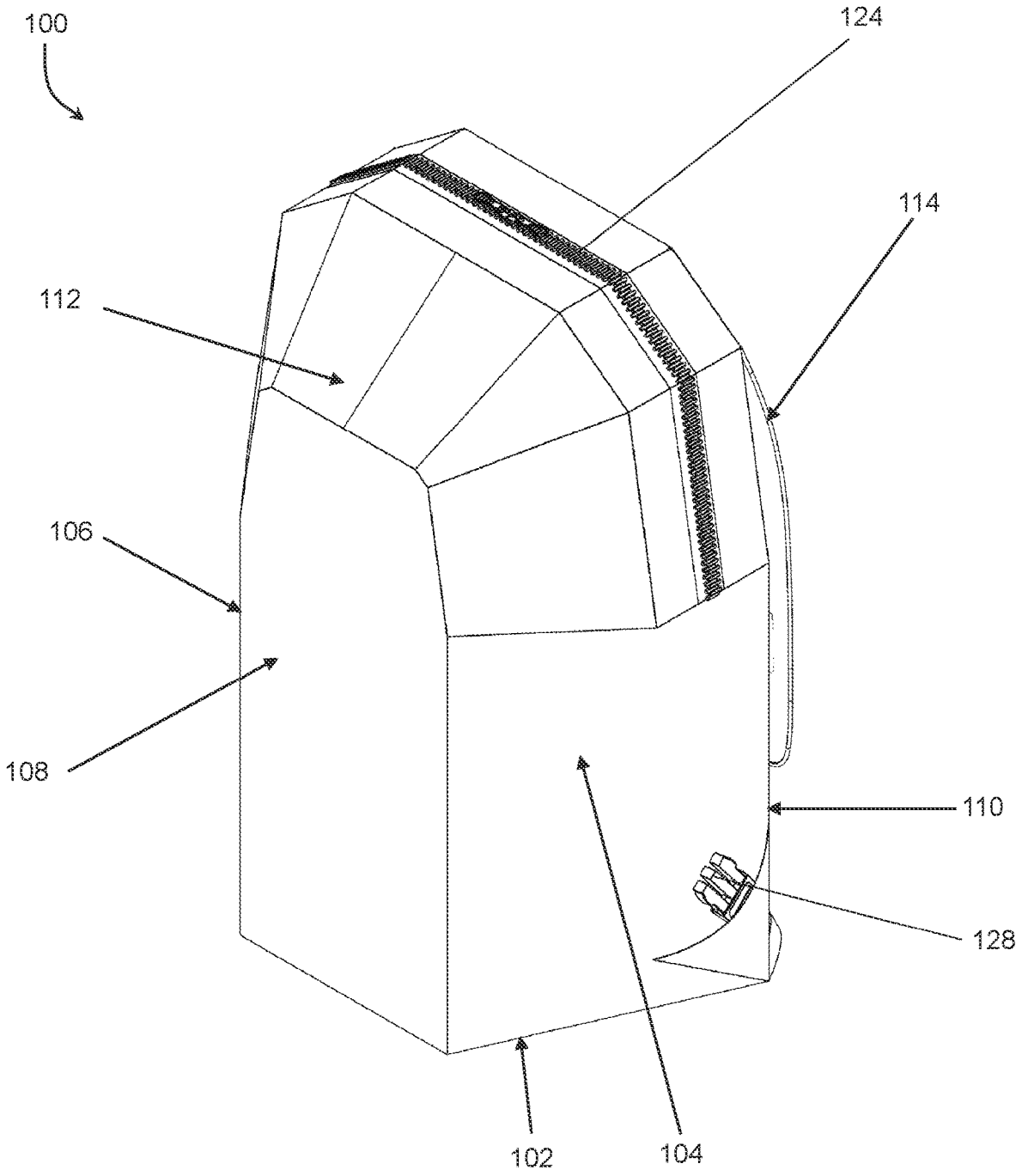
FIG. 1 is a front isometric view of a backpack that can convert into a laptop stand in accordance with an embodiment of the present invention.

An illustrative embodiment of the present invention relates to a backpack that can convert into a laptop stand which can function as both a backpack for the storage and transport of a laptop computer and a stand or riser for supporting the laptop on a user's lap, between the knees, or on the floor.

FIGS. 1 through 11, wherein like parts are designated by like reference numerals throughout, illustrate an example embodiment or embodiments of a backpack laptop riser, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

The backpack that can convert into a laptop stand of the present invention enables use as both a backpack with laptop storage and a laptop stand or riser for a more comfortable and stable working experience with the laptop. A conventional backpack with two straps does not have the necessary components to be used as a laptop stand or riser, and a laptop stand is convenient considering a backpack carries laptops and laptop stands or risers make using a laptop more comfortable and ergonomic.

Figure 2:
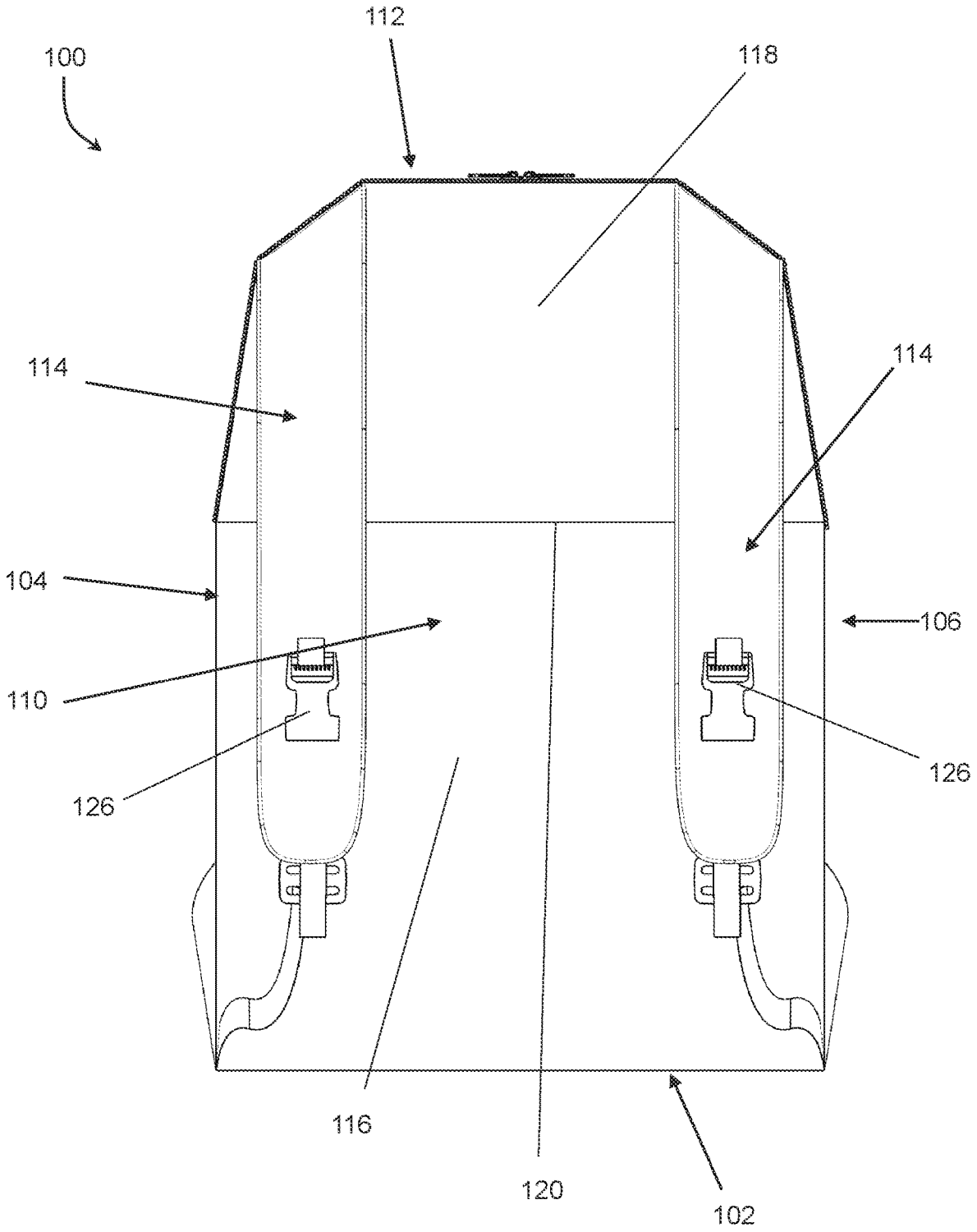
FIG. 2 is a rear view of a backpack that can convert into a laptop stand in accordance with an embodiment of the present invention.

FIG. 1 and FIG. 2 show an isometric front view and back view respectively of the backpack 100 of the present invention. The backpack 100 comprises a rigid bottom panel 102, a first rigid side panel 104, a second rigid side panel 106, a rigid front panel 108, a rigid back panel 110, a soft top panel 112, and a pair of straps 114. The first rigid side panel 104 and the second rigid side panel 106 are attached to opposite sides of the rigid bottom panel 102. The rigid front panel 108 is attached to the rigid bottom panel 102, the first rigid side panel 104, and the second rigid side panel 106.

Figure 4:
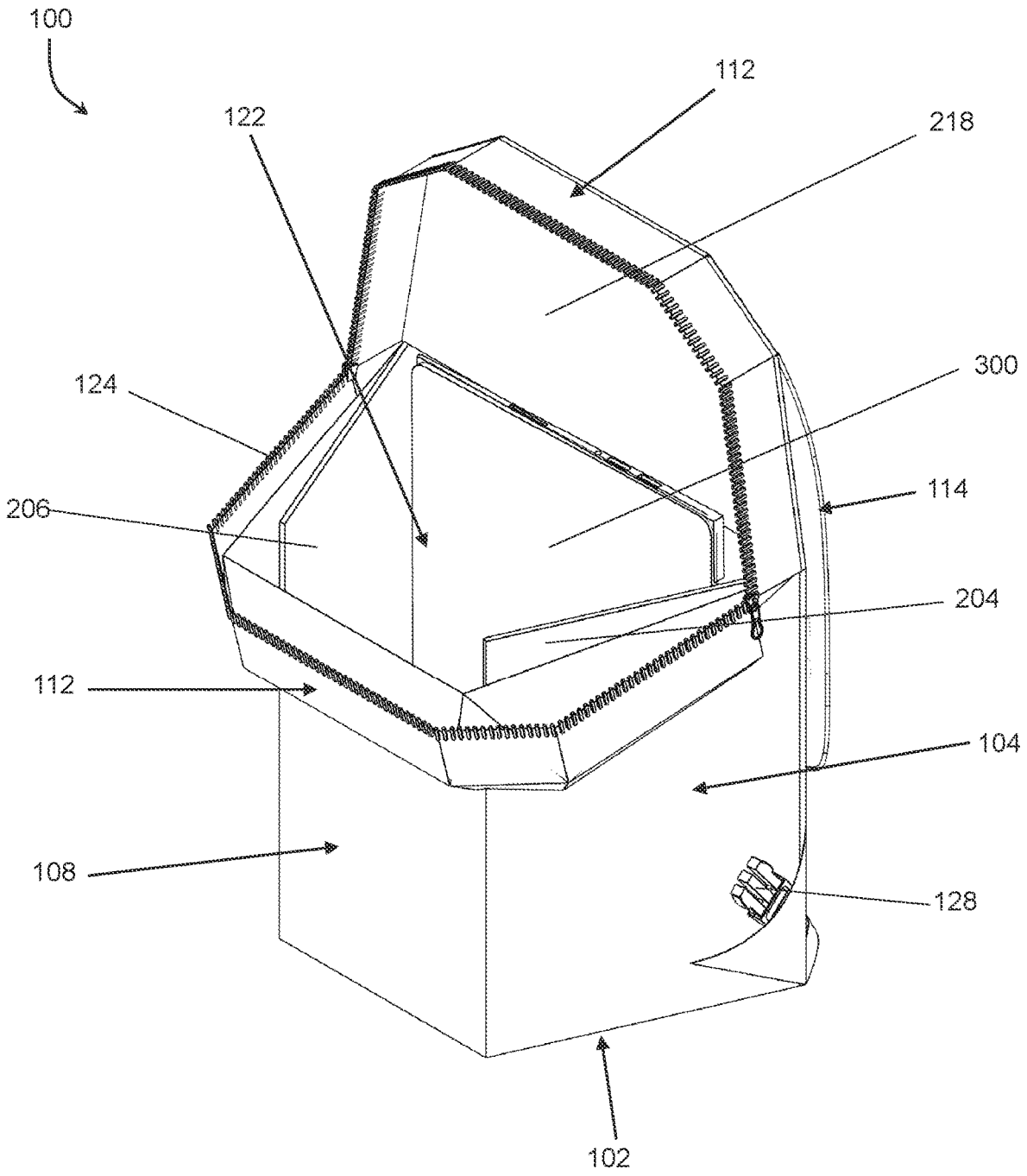
FIG. 4 is a front isometric view of a backpack that can convert into a laptop stand showing the interior volume and frame of the backpack holding a laptop in accordance with an embodiment of the present invention.
Figure 5:
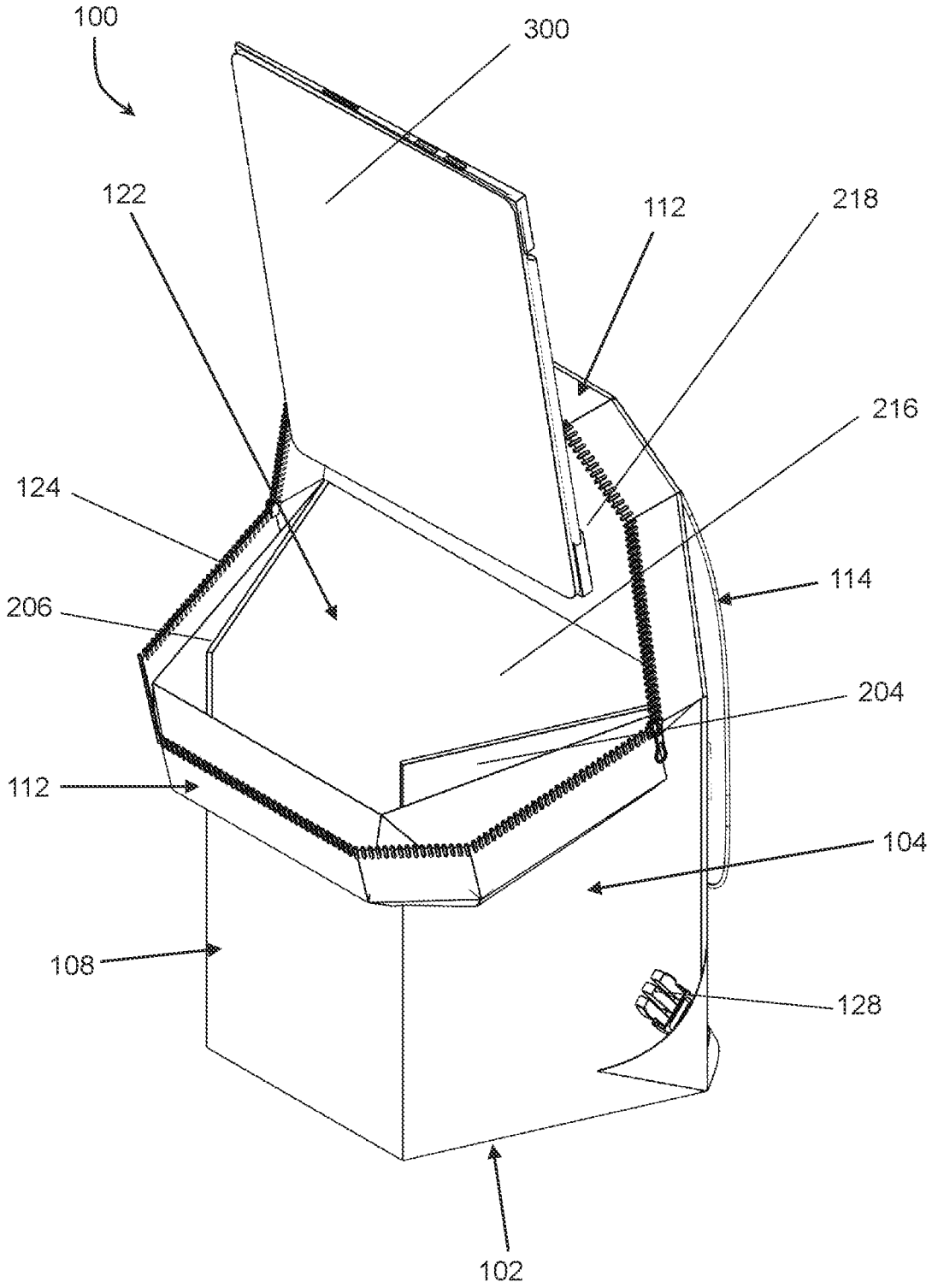
FIG. 5 is a front isometric view of a backpack that can convert into a laptop stand showing the laptop being removed from the interior volume in accordance with an embodiment of the present invention.
Figure 6:
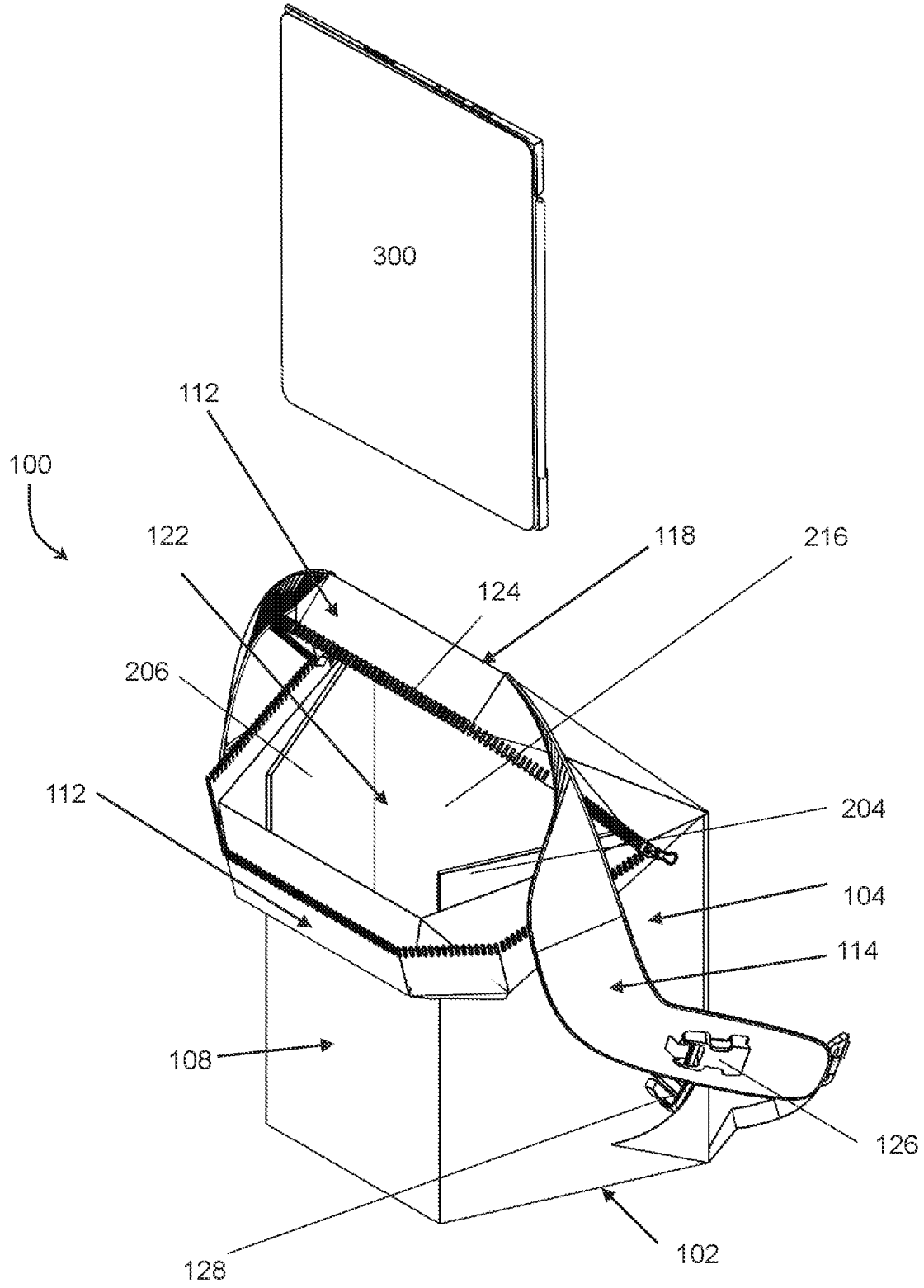
FIG. 6 is a front isometric view of a backpack being converted into a laptop stand in accordance with an embodiment of the present invention.

The rigid back panel 110 comprises a rigid bottom back panel 116 and a top rigid back panel 118 pivotably attached to the rigid bottom back panel 116 (here via a hinge 120) and configured to fold down in one direction. The rigid bottom back panel 116 is attached to the rigid bottom panel 102, the first rigid side panel 104, and the second rigid side panel 106 opposite the rigid front panel 108. The attached rigid bottom panel 102, first rigid side panel 104, second rigid side panel 106, rigid front panel 108, and rigid back panel 110 define an interior volume 122 (As shown in FIGS. 4-6) of the backpack 100.

The soft top panel 112 is attached to the rigid front panel 108, the first rigid side panel 104, the second rigid side panel 106, and the rigid back panel 110 opposite the rigid bottom panel 102 enclosing the interior volume of the backpack and having a closeable opening 124 into the interior volume 122. In certain embodiments, such as shown here, this closeable opening 124 comprises a zippered opening. Other possible configurations and means of providing a closeable opening 124 will be apparent to one skilled in the art given the benefit of this disclosure.

The pair of shoulder straps 114 are attached to and extend between the top rigid back panel 118 and the first and second rigid side panels 104, 106 in proximity to the rigid bottom panel 102 and configured to allow the backpack 100 to be worn by a user. In certain embodiments, securing means 126, are disposed on the straps 114 as well as corresponding securing means 128 disposed on each of the first and second rigid side panels 104, 106 in proximity to the rigid bottom panel 102. In some such embodiments, such as shown here, the securing means 126, 128 comprise interlocking clip mechanisms. Other potential securing means include but are not limited to, hooks, latches, straps, buttons, snaps, hook and loop fasteners, or the like, each of which would be understood by those of skill in the art given the benefit of this disclosure and therefore not required to be additionally depicted in the drawings.

Figure 3:
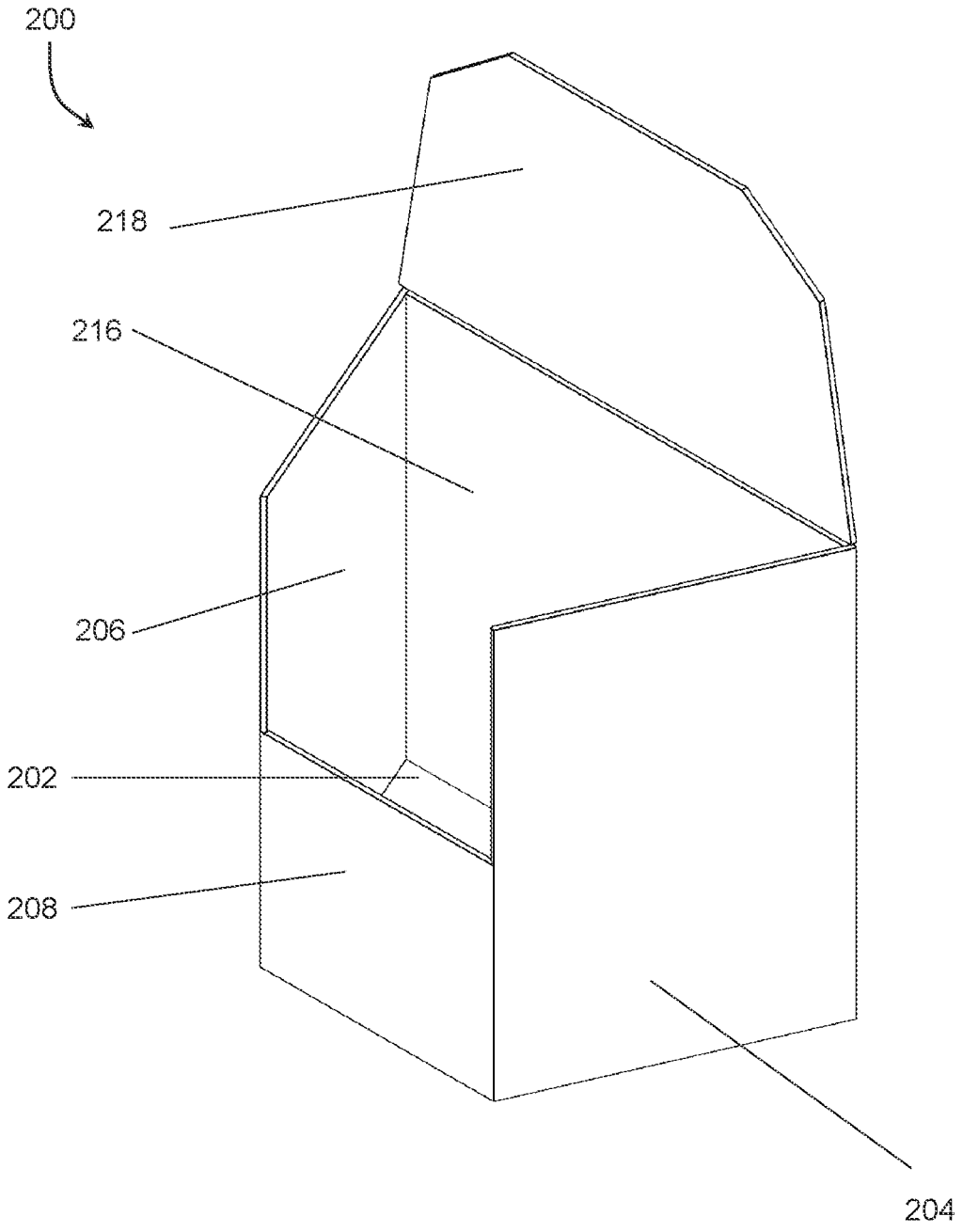
FIG. 3 is a front isometric view of a frame of a backpack that can convert into a laptop stand in accordance with an embodiment of the present invention.

In certain embodiments, one or more of the rigid bottom panel 102, first rigid side panel 104, second rigid side panel 106, rigid front panel 108, rigid bottom back panel 116, and top rigid back panel 118 comprise an outer shell (shown in the figures as the outer surface of rigid bottom panel 102, first rigid side panel 104, second rigid side panel 106, rigid front panel 108, rigid bottom back panel 116, and top rigid back panel 118) comprising a flexible material, and a frame 200 (as seen in FIG. 3) comprising a rigid material providing structure and support for the outer shell. The flexible material of the outer shell may comprise a fabric, such as canvas or nylon, commonly used in the construction of backpacks. The frame 200 may preferably be formed of plastic or composite material, such fibers mixed with a polymer. In certain embodiments, the frame 200 comprises a sheet of rigid material. An example of this can be seen in FIG. 3. Materials that can be used to form the frame 200 and/or the rigid sheet can include plastic, composite, wood, metal, equivalents, and/or combinations thereof, as would be understood by those of ordinary skill in the art.

FIG. 3 shows a frame 200 in isolation from the outer shell of backpack 100. Here the frame includes a front panel 202, a first rigid side panel 204, a second rigid side panel 206, a front panel 208, a bottom back panel 216, and a top back panel 218 corresponding to the rigid bottom panel 102, first rigid side panel 104, second rigid side panel 106, rigid front panel 108, rigid bottom back panel 116, and top rigid back panel 118 of the backpack 100. In this example, the frame panels 202, 204, 206, 208, 216, and 218 are attached to each other to form one singular frame 200. However, it should be understood that the frame panels 202, 204, 206, 218, 216, and 218 do not need to be attached to each other to provide the necessary support for the outer shell of the respective rigid bottom panel 102, first rigid side panel 104, second rigid side panel 106, rigid front panel 108, rigid bottom back panel 116, and top rigid back panel 118. In some embodiments, the frame 200 may be enclosed within or otherwise surrounded by the material of the outer shell. Similarly, the individual frame panels 202, 204, 206, 218, 216, and 218 may be enclosed within or otherwise surrounded by the material of the corresponding rigid bottom panel 102, first rigid side panel 104, second rigid side panel 106, rigid front panel 108, rigid bottom back panel 116, and top rigid back panel 118. In some embodiments, as seen here, the front panel 208 may be smaller than the corresponding outer shell of the rigid front panel 108.

Figure 7:
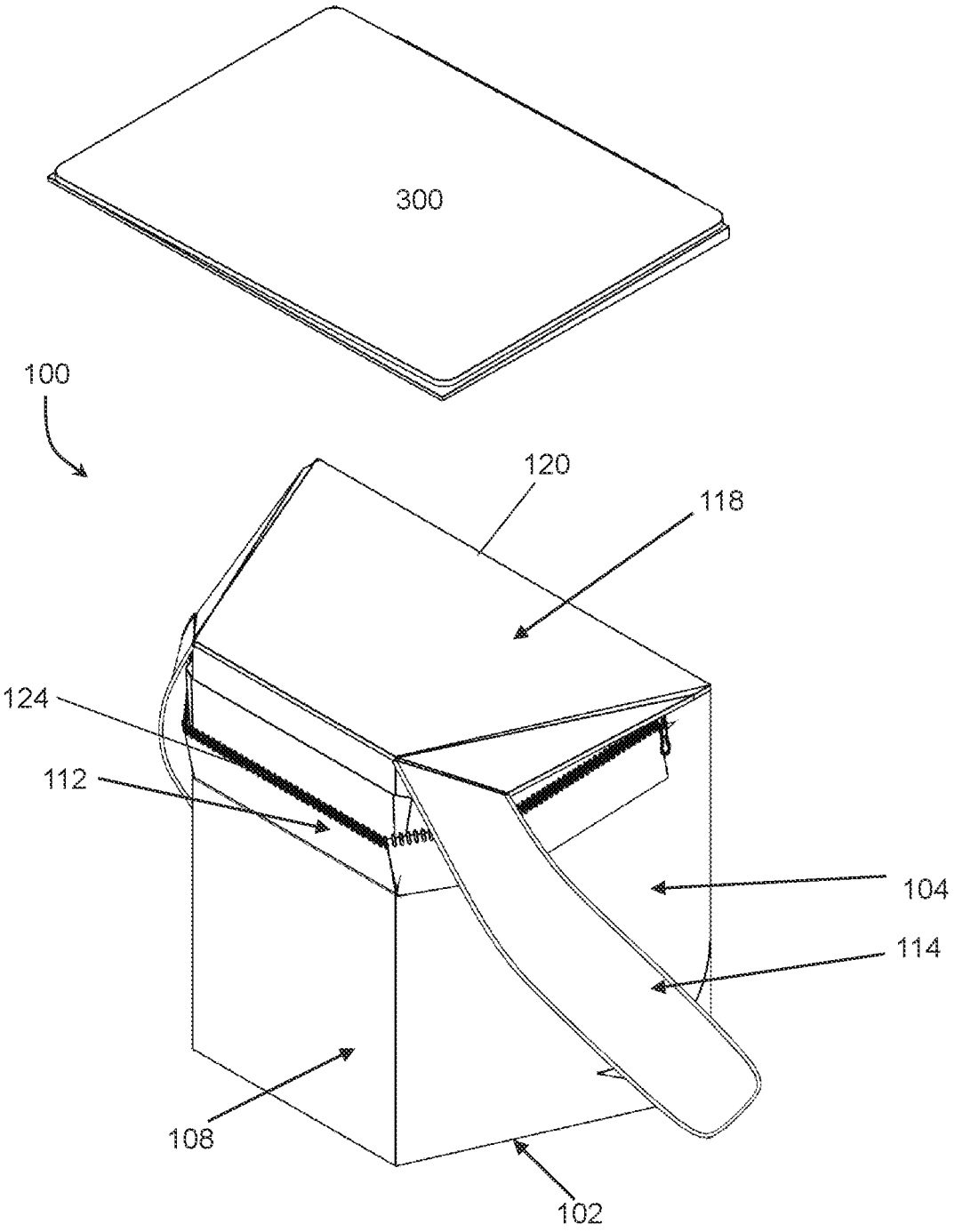
FIG. 7 is a front isometric view of a backpack converted into a rigid box forming the laptop stand in accordance with an embodiment of the present invention.
Figure 8:
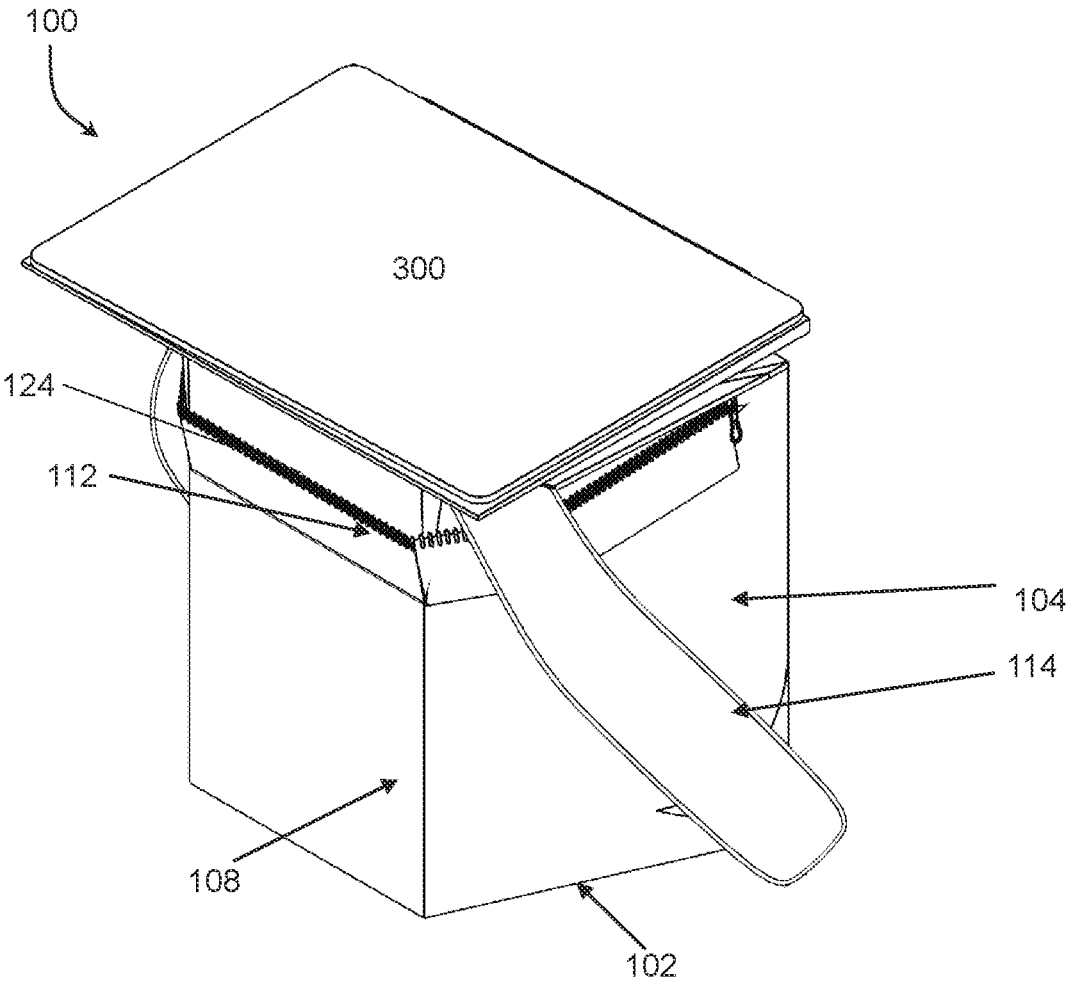
FIG. 8 is a front isometric view of a backpack converted into a rigid box forming the laptop stand supporting a laptop in accordance with an embodiment of the present invention.

FIGS. 4 through 10 depict the backpack in operation. FIG. 4 depicts the closeable opening 124 in an open condition revealing the interior volume 122 of the backpack 100 and a laptop 300 stowed within. FIG. 5 depicts the laptop 300 being removed from the interior volume 122 of the backpack 100. Once the laptop has been removed, the top rigid back panel 118 can fold down over the soft top panel 112 and the interior volume 122 of the backpack 100 using hinge 120, as seen in FIG. 6, to meet with the first right side panel 104 and second rigid side panel 106 forming a rigid box, as seen in FIG. 7, for supporting a laptop 300 in a vertical orientation, as seen in FIG. 8, wherein the laptop 300 is placed on the top rigid back panel 118. When the backpack 100 is folded into the rigid box configuration for supporting the laptop 300, the top rigid back panel 118 establishes a substantially flat surface configured to support the laptop 300. This creates an environment where the laptop 300 can be properly supported and where cooling ducts of the laptop 300 can appropriately, as designed, expel heat from the laptop 300 because they are not obstructed by, e.g., bunched fabric, or a surface that is too soft, which can otherwise obstruct heat dissipation.

In some embodiments, when the top rigid back panel 118 is folded over the soft top panel 112 and the interior volume 122 of the backpack 100 via the hinge 120, each strap 114 can be positioned across a rigid side panel 104, 106 and secured to their respective side panel 104, 106 using the securing means 126, 128 to hold the top rigid back panel 118 in position over the soft top panel 112 and the interior volume 122 of the backpack to form the rigid box. This also keeps the straps 114 from dangling where they can be more easily snagged.

Figure 9:
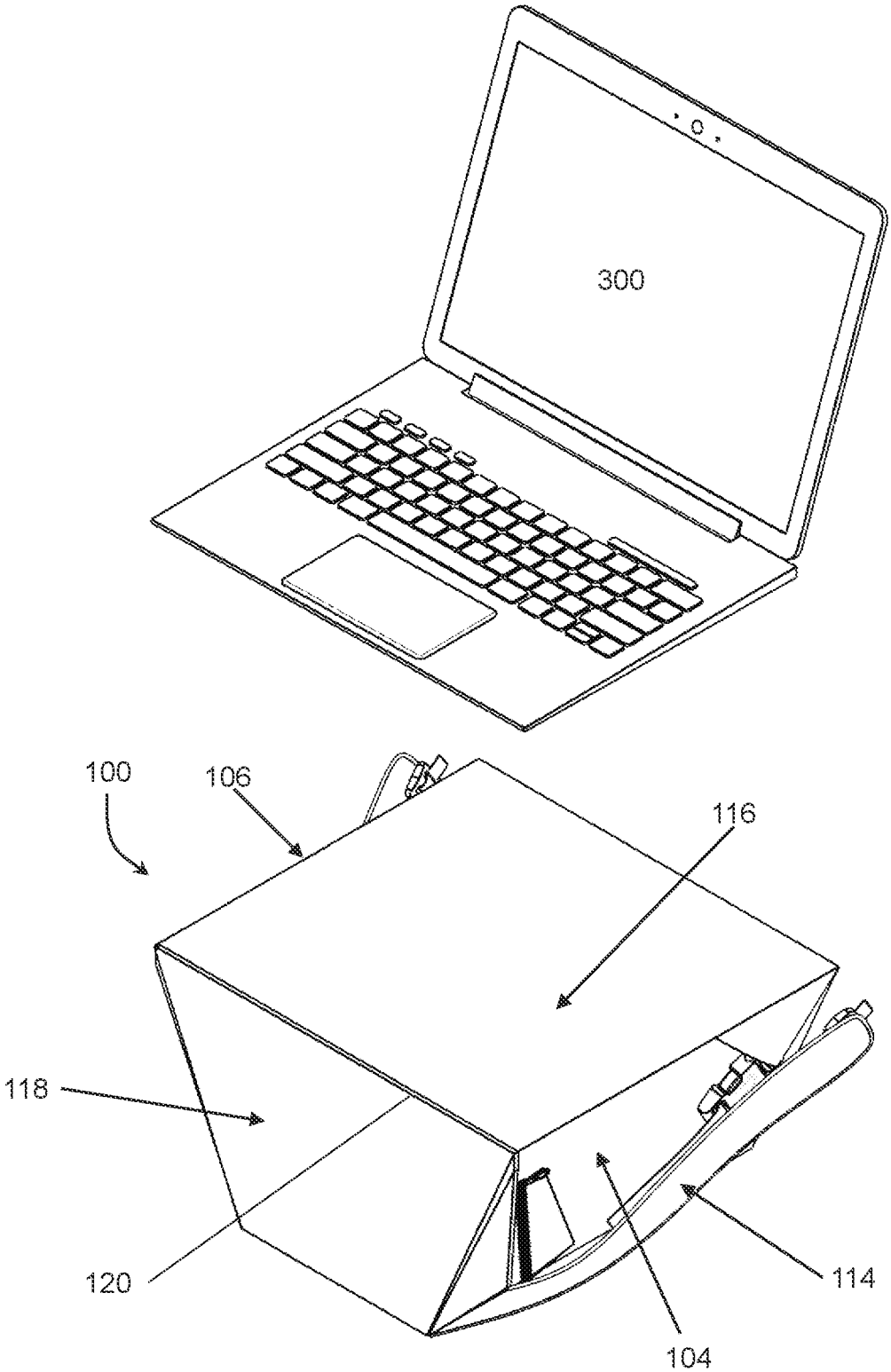
FIG. 9 is a front isometric view of a backpack converted into a rigid box forming the laptop stand wherein the rigid box is horizontally oriented in accordance with an embodiment of the present invention.
Figure 10:
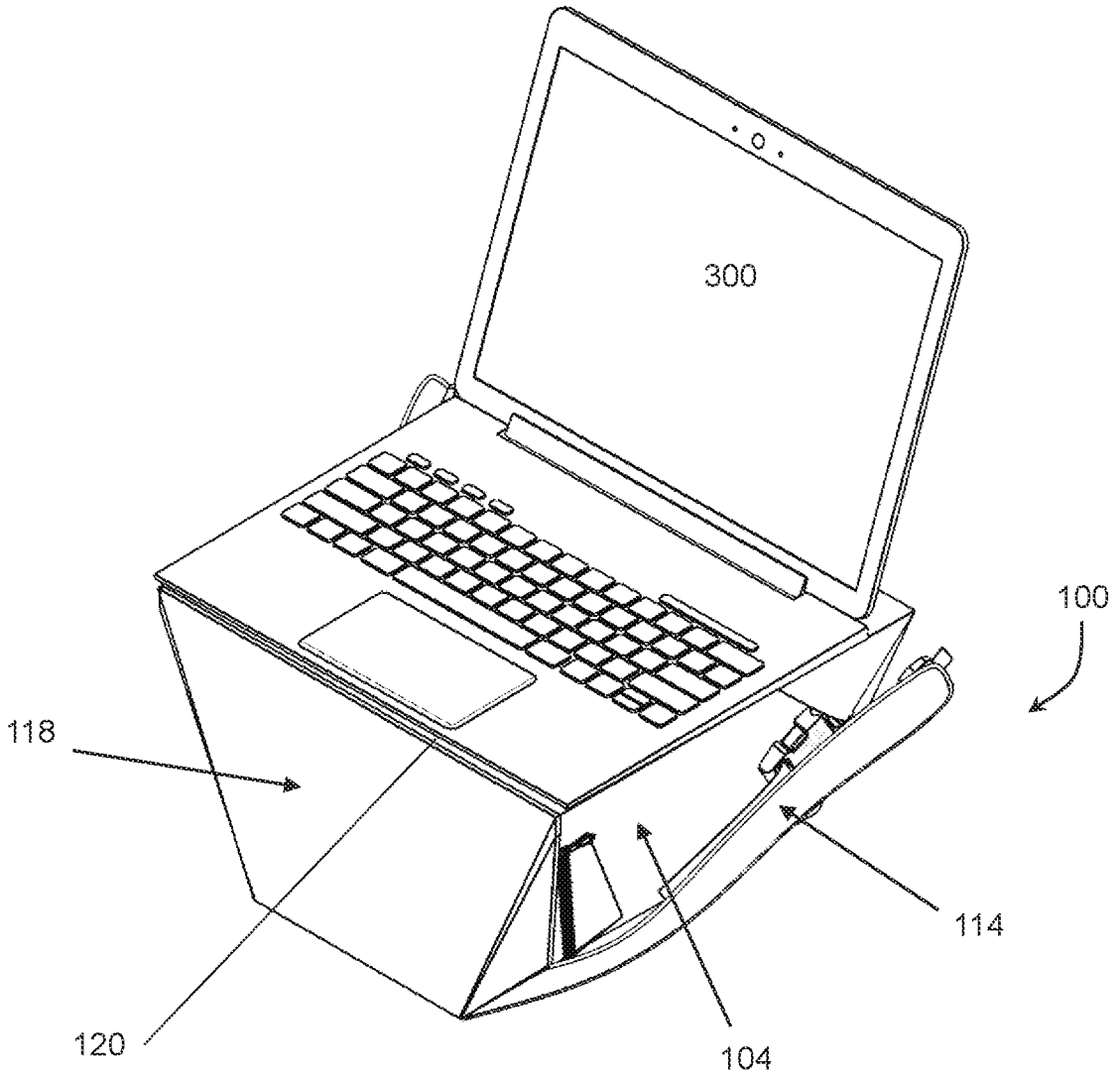
FIG. 10 is the rigid box in the horizontal orientation supporting a laptop in accordance with an embodiment of the present invention.

Once the straps 114 have been secured to the rigid side panels 104, 106 and the top rigid back panel 118 held in place to form the rigid box, the rigid box may also be oriented horizontally, as seen in FIG. 9, wherein the laptop 300 can be placed upon the rigid bottom back panel 116, as seen in FIG. 10. When the backpack 100 is folded into the rigid box configuration for supporting the laptop 300, the bottom rigid back panel 116 establishes a substantially flat surface configured to support the laptop 300. This creates an environment where the laptop 300 can be properly supported and where cooling ducts of the laptop 300 can appropriately, as designed, expel heat from the laptop 300 because they are not obstructed by, e.g., bunched fabric, or a surface that is too soft, which can otherwise obstruct heat dissipation.

In certain embodiments, the rigid front panel 108 has a width dimension that is less than a width dimension of the rigid back panel 110 and the rigid bottom panel 102 has a substantially trapezoidal shape. In still further embodiments, the top rigid back panel 118 is configured to match the trapezoidal shape of rigid bottom panel 102 such that the rigid box formed by folding the top rigid back panel 118 over the soft top panel 112 and the interior volume 122 of the backpack 100 to meet with the first right side panel 104 and second rigid side panel 106 has a substantially trapezoidal cross-sectional shape. Such a trapezoidal cross-section allows the rigid box to fit more comfortably between a user's legs.

Figure 11:
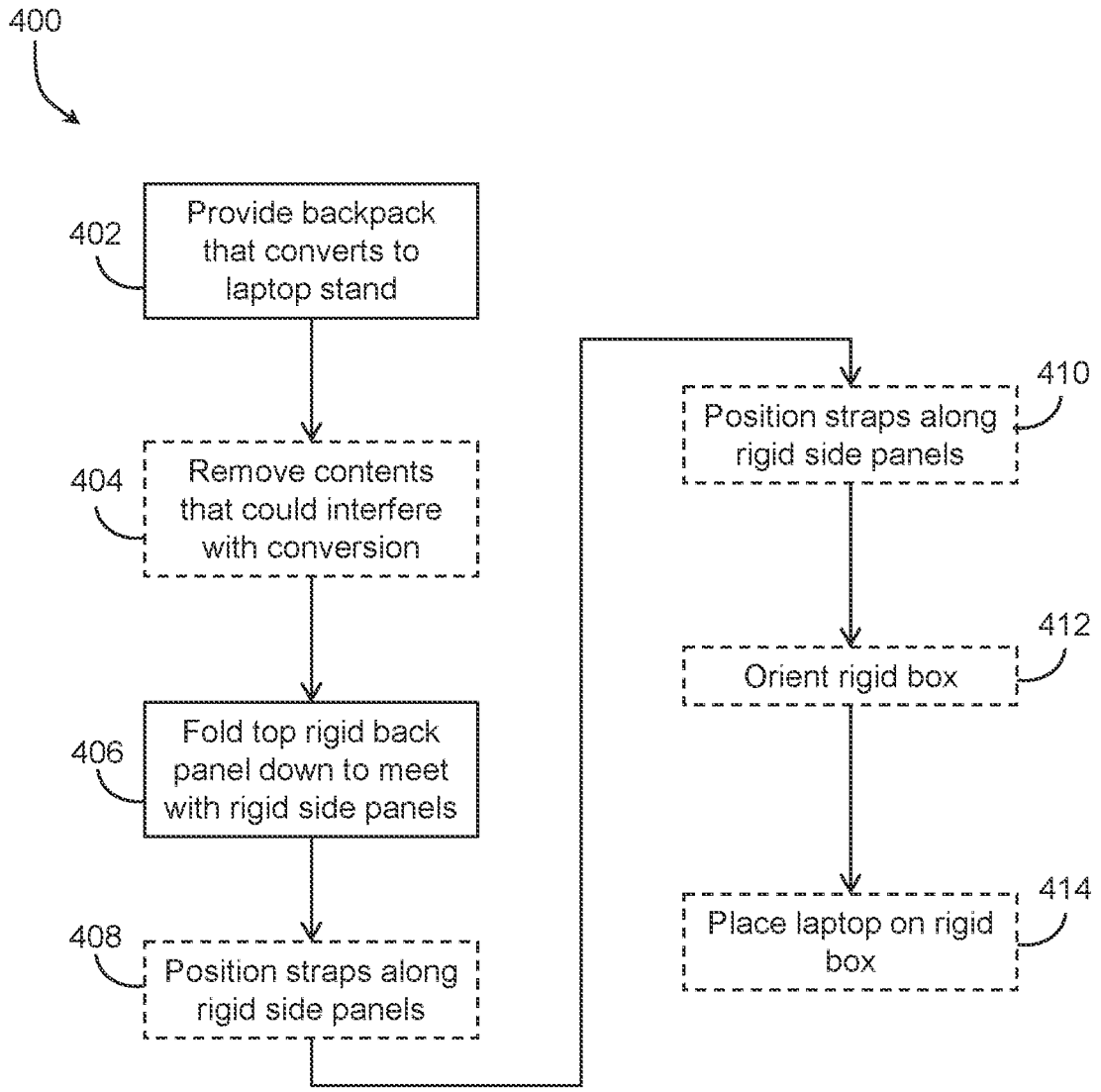
FIG. 11 depicts a flow diagram of a methodology for converting the backpack of the present invention into a laptop stand in accordance with an embodiment of the present invention.

FIG. 11 depicts a flow diagram 400 for converting the backpack 100 of the present invention into a laptop stand as described above. The first step of the method comprises providing the backpack 100 that converts into a laptop stand as described herein (Step 402). If the backpack contains contents that could prevent the conversion, such as laptop 300 stored in the interior volume 122 that would interfere with the folding down of the top rigid back panel 118, such as seen in FIG. 4, the optional step of removing such contents can be performed (Step 404), such as seen in FIG. 5. The top rigid back panel 118 can then be folded down over the soft top panel 112 and the interior volume 122 of the backpack 100 to meet with the rigid side panels 104, 106 to form the rigid box as seen in FIG. 6 and FIG. 7 (Step 406). In embodiments where the straps 114 and side panels 104, 106 are provided with securing means 126, 128; the optional steps of positioning each strap 114 along the side panel 104, 106 as seen in FIG. 6 (Step 408) and securing each strap 114 to the respective side panel 104, 106 using the securing means 126, 128 to hold the top rigid back panel 118 in position over the soft top panel 112 and the interior volume 122 of the backpack 100 to form the rigid box (Step 410) as seen in FIG. 7. In such embodiment, the rigid box may be then oriented horizontally (Step 412) as seen in FIG. 9. When the rigid box is in the desired vertical or horizontal a laptop 300 can then be placed upon a rigid panel 116, 118 of the rigid box (Step 414) as seen in FIG. 8 and FIG. 10.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may be existing in the top and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extent or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way that enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A backpack that converts into a laptop stand, the backpack comprising:

a rigid bottom panel;

a first rigid side panel attached to the rigid bottom panel;

a second rigid side panel attached to the rigid bottom panel opposite the first rigid side panel;

a rigid front panel attached to the rigid bottom panel, the first rigid side panel, and the second rigid side panel;

a rigid back panel comprising:

a rigid bottom back panel attached to the rigid bottom panel, the first rigid side panel, and the second rigid side panel opposite the rigid front panel; and a top rigid back panel pivotably attached to the rigid bottom back panel and configured to fold down in one direction;

wherein the attached rigid bottom, first rigid side panel side, second rigid side panel, rigid front panel, and rigid back panel define an interior volume of the backpack, a soft top panel attached to the rigid front panel, the first and second rigid side panel and the rigid back panel opposite the rigid bottom panel enclosing the interior volume of the backpack and having a closeable opening into the interior volume; and a pair of shoulder straps attached to and extending between the top rigid back panel and the first and second rigid side panels in proximity to the rigid bottom panel and configured to allow the backpack to be worn by a user;

wherein the top rigid back panel is configured to fold down over the soft top panel and the interior volume of the backpack to meet with the side panels forming a rigid box for supporting a laptop.

2. The backpack of claim 1, wherein the closeable opening of the soft top panel comprises a zippered opening.

3. The backpack of claim 1 further comprising:

securing means disposed on each strap of the pair of shoulder straps; and securing mean disposed on each of the first and second rigid side panels in proximity to the rigid bottom panel;

wherein when the top rigid back panel is folded over the soft top panel and the interior volume of the backpack, each strap can be positioned across a side panel and secured to their respective side panel using the securing means to hold the top rigid back panel in position over the soft top panel and the interior volume of the backpack to form the rigid box.

4. The backpack of claim 3, wherein the securing means comprises one or more of clips, hooks, latches, straps, buttons, snaps, and hook and loop fasteners.

5. The backpack of claim 3, wherein the rigid box can be used in a vertical or horizontal position for supporting a laptop.

6. The backpack of claim 1, wherein the rigid front panel has a width dimension that is less than a width dimension of the rigid back panel and the rigid bottom panel has a substantially trapezoidal shape.

7. The backpack of claim 6, wherein the top rigid back panel is configured to match the trapezoidal shape of rigid bottom panel such that the rigid box formed by folding the top rigid back panel over the soft top panel and the interior volume of the backpack to meet with the rigid front and side panels has a substantially trapezoidal cross-sectional shape.

8. The backpack of claim 1, wherein one or more of the rigid bottom, side, front, and back panels comprise an outer shell comprising a flexible material, and a frame comprising a rigid material providing structure and support for the outer shell.

9. The backpack of claim 8, wherein the flexible material of the outer shell comprises a fabric.

10. The backpack of claim 8, wherein the frame comprises a sheet of rigid material.

11. The backpack of claim 8, where the rigid material of the frame comprises one or more of plastic, composite, wood, metal, and combinations thereof.

12. The backpack of claim 1, wherein when the backpack is folded into the rigid box configuration for supporting the laptop, the rigid back establishes a substantially flat surface configured to support the laptop.

13. A method of using a backpack that converts into a laptop stand, the method comprising:

providing a backpack that converts into a laptop stand, wherein the backpack comprises:

a rigid bottom panel;

a first rigid side panel attached to the rigid bottom panel;

a second rigid side panel attached to the rigid bottom panel opposite the first rigid side panel;

a rigid front panel attached to the rigid bottom panel, the first rigid side panel, and the second rigid side panel;

a rigid back panel comprising:

a rigid bottom back panel attached to the rigid bottom panel, the first rigid side panel, and the second rigid side panel opposite the rigid front panel; and a top rigid back panel pivotably attached to the rigid bottom back panel and configured to fold down in one direction;

wherein the attached rigid bottom, first rigid side panel side, second rigid side panel, rigid front panel, and rigid back panel define an interior volume of the backpack, a soft top panel attached to the rigid front panel, the first and second rigid side panel and the rigid back panel opposite the rigid bottom panel enclosing the interior volume of the backpack and having a closeable opening into the interior volume; and a pair of shoulder straps attached to and extending between the top rigid back panel and the first and second rigid side panels in proximity to the rigid bottom panel and configured to allow the backpack to be worn by a user;

wherein the top rigid back panel is configured to fold down over the soft top panel and the interior volume of the backpack to meet with the side panels forming a rigid box for supporting a laptop; and folding the top rigid back panel down over the soft top panel and the interior volume of the backpack to meet with the side panels to form the rigid box.

14. The method of claim 13 further comprising:

removing contents from the interior volume of the backpack that would interfere with conversion of the backpack into the laptop stand.

15. The method of claim 13, wherein the backpack further comprises:

securing means disposed on each strap of the pair of shoulder straps; and securing mean disposed on each of the first and second rigid side panels in proximity to the rigid bottom panel;

wherein when the top rigid back panel is folded over the soft top panel and the interior volume of the backpack, each strap can be positioned across a side panel and secured to their respective side panel using the securing means to hold the top rigid back panel in position over the soft top panel and the interior volume of the backpack to form the rigid box.

16. The method of claim 15, wherein the method further comprises:

positioning each strap along the side panel; and securing each strap to the respective side panel using the securing means to hold the top rigid back panel in position over the soft top panel and the interior volume of the backpack to form the rigid box.

17. The method of claim 16, further comprising:

orienting the rigid box horizontally.

18. The method of claim 13, further comprising:

placing a laptop upon a rigid panel of the rigid box.

* * * * *